US009201358B2

(12) United States Patent
Kanou

(10) Patent No.: US 9,201,358 B2
(45) Date of Patent: Dec. 1, 2015

(54) FUSER AND IMAGE FORMING APPARATUS WITH AN ENDLESS BELT BODY AND TENSION MEMBER

(71) Applicant: Konica Minolta, Inc., Chiyoda-ku (JP)

(72) Inventor: Hirotaka Kanou, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/604,015

(22) Filed: Jan. 23, 2015

(65) Prior Publication Data

US 2015/0212463 A1 Jul. 30, 2015

(30) Foreign Application Priority Data

Jan. 29, 2014 (JP) ..... 2014-014466

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/329, 328, 323, 320
See application file for complete search history.

(56) References Cited

U.S. PATENT DOCUMENTS

| | | | | |
|---|---|---|---|---|
| 6,597,888 | B1 | 7/2003 | Abe et al. | |
| 2010/0303523 | A1* | 12/2010 | Yamada | 399/323 |
| 2011/0044734 | A1 | 2/2011 | Shimokawa et al. | |
| 2013/0136512 | A1 | 5/2013 | Suzuki et al. | |

FOREIGN PATENT DOCUMENTS

| | | | |
|---|---|---|---|
| JP | 2001-83822 | A | 3/2001 |
| JP | 2008-151902 | A | 7/2008 |
| JP | 2009-301031 | A | 12/2009 |
| JP | 2011-43666 | A | 3/2011 |
| JP | 2013-114058 | A | 6/2013 |
| JP | 2014-6317 | A | 1/2014 |

* cited by examiner

*Primary Examiner* — Billy Lactaoen
(74) *Attorney, Agent, or Firm* — Buchanan Ingersoll & Rooney

(57) ABSTRACT

A fuser including a fusing roller member configured to heat an unfixed toner image on a recording material, and a pressure roller member making pressure-contact with the fusing roller member, the fuser configured to fix the toner image by passing the recording material through a fusing nip between the fusing roller member and the pressure roller member, includes: an endless belt body constituting an outer peripheral portion of the fusing roller member or the pressure roller member, the endless belt body rotating in a predetermined circumferential path; a pressing member configured to press the fusing nip from the inside of the belt body; a separating member configured to separate the recording material from the belt body; and a tension member abutting on an inside of the belt body for tension, the tension member configured to maintain a gap between the belt body and the separating member.

8 Claims, 8 Drawing Sheets

FUSER AND IMAGE FORMING APPARATUS WITH AN ENDLESS BELT BODY AND TENSION MEMBER

The entire disclosure of Japanese Patent Application No. 2014-014466 filed on Jan. 29, 2014 including description, claims, drawings, and abstract are incorporated herein by reference in its entirety.

BACKGROUND OF THE INVENTION

1. Field of the Invention

The present invention relates to a fuser configured to pass and fuse a recording material with an unfixed toner image thereon through a fusing nip between a fusing roller member and a pressure roller member, and an image forming apparatus including the fuser. The image forming apparatus variously includes a copying machine, a printer, a facsimile machine, and a multifunction printer having integrated their functions.

2. Description of the Related Art

Conventional electrophotographic image forming apparatuses generally fix a toner image on a recording material by conveying, heating, and pressing the recording material having an unfixed toner image transferred thereon through a fusing nip between a fusing roller member configured to heat the unfixed toner image on the recording material and a pressure roller member making pressure-contact with the fusing roller member.

As a fuser of this kind, JP 2013-114058 A discloses a fuser which has a fusing roller member having an outer peripheral portion including an endless belt body. Further, JP 2013-114058 A discloses a configuration in which a guide is provided upstream of the fusing nip to stabilize the axial circumferential position of a belt body.

However, as illustrated in FIG. 11, in a conventional fuser as disclosed in JP 2013-114058 A, a gap is between a pressing member and a belt body at room temperature, the belt body is floated toward a pressing member upon start of warming up, and a radial circumferential position of the belt body is made unstable. The belt body having the unstable circumferential position is caused to make contact with a separating member disposed with a gap (e.g., 0.2 mm to 0.7 mm) therebetween. By contact of the belt body with a separating member, a contact trace remains on the belt body, and the contact trace disadvantageously generates uneven gloss upon fixing an image.

Further, in a configuration of the conventional fuser, in order to avoid the contact between the belt body and the separating member, considerable reduction of a relative adjustable width between the belt body and the separating member, or the like has been employed. However, the conventional fuser needs to be finely adjusted, needs a skilled engineer, and it takes a long time to adjust.

On the other hand, for avoidance only contact between the belt body and the separating member, increase of a gap between the belt body and the separating member is possible. However, when the gap between the belt body and the separating member is excessively increased, such a thin paper sheet as having an image with much toner (solid image) thereon cannot be separated and is wound around the belt body, and the separating member unfortunately does not function.

SUMMARY OF THE INVENTION

A technical object of the present invention is to provide a fuser configured to stabilize a circumferential position of a belt body and prevent contact between the belt body and a separating member, for surely secured fusing quality, and an image forming apparatus including the fuser.

To achieve the abovementioned object, according to an aspect, a fuser including a fusing roller member configured to heat an unfixed toner image on a recording material, and a pressure roller member making pressure-contact with the fusing roller member, and configured to fix the toner image by passing the recording material through a fusing nip between the fusing roller member and the pressure roller member, reflecting one aspect of the present invention comprises an endless belt body constituting an outer peripheral portion of the fusing roller member or the pressure roller member and rotating in a predetermined circumferential path, a pressing member configured to press the fusing nip from the inside of the belt body, a separating member configured to separate the recording material from the belt body, and a tension member abutting on an inside of the belt body for tension and maintaining a gap between the belt body and the separating member.

According to the invention of Item. 2, in the fuser of Item. 1, a gap is preferably formed between the belt body and the pressing member, excluding the fusing nip and a vicinity of the fusing nip.

According to the invention of Item. 3, in the fuser of Item. 1 or 2, the fuser preferably includes a restriction flange disposed along each longitudinal end surface of the belt body, the restriction flange configured to restrict a longitudinal position of the belt body, and the tension member is preferably fixed to the restriction flange, and abuts on each longitudinal end of the belt body.

According to the invention of Item. 4, in the fuser of Item. 1 or 2, the tension member preferably includes a protruding portion configured to make contact with an inner surface of the belt body on downstream side from the fusing nip in the circumferential path of the belt body, outwardly protrude the circumferential path of the belt body, and increase a curvature of the circumferential path.

According to the invention of Item. 5, in the fuser of Item. 1 or 2, the tension member is preferably extended over substantially the longitudinal direction of the belt body, and preferably abuts on an inside of the belt body.

According to the invention of Item. 6, in the fuser of any one of Items. 1 to 4, the belt body is preferably longer than the fusing nip in the longitudinal direction, and the tension member is preferably disposed outside an area of the fusing nip.

According to the invention of Item. 7, in the fuser of any one of Items. 1 to 6, the pressing member preferably has a roller shape, includes a material expanded upon heating, and when the pressing member is thermally expanded, pressure-contact between the tension member and the belt body is preferably reduced.

According to the invention of Item. 8, in the fuser of any one of Items. 1 to 7, the fuser preferably includes a heating unit disposed to face the circumferential surface of the belt body and configured to inductively heat a metal material, and the belt body preferably includes a heating layer including a metal material.

According to the invention of Item. 9, an image forming apparatus preferably includes the fuser of any one of Items. 1 to 8.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
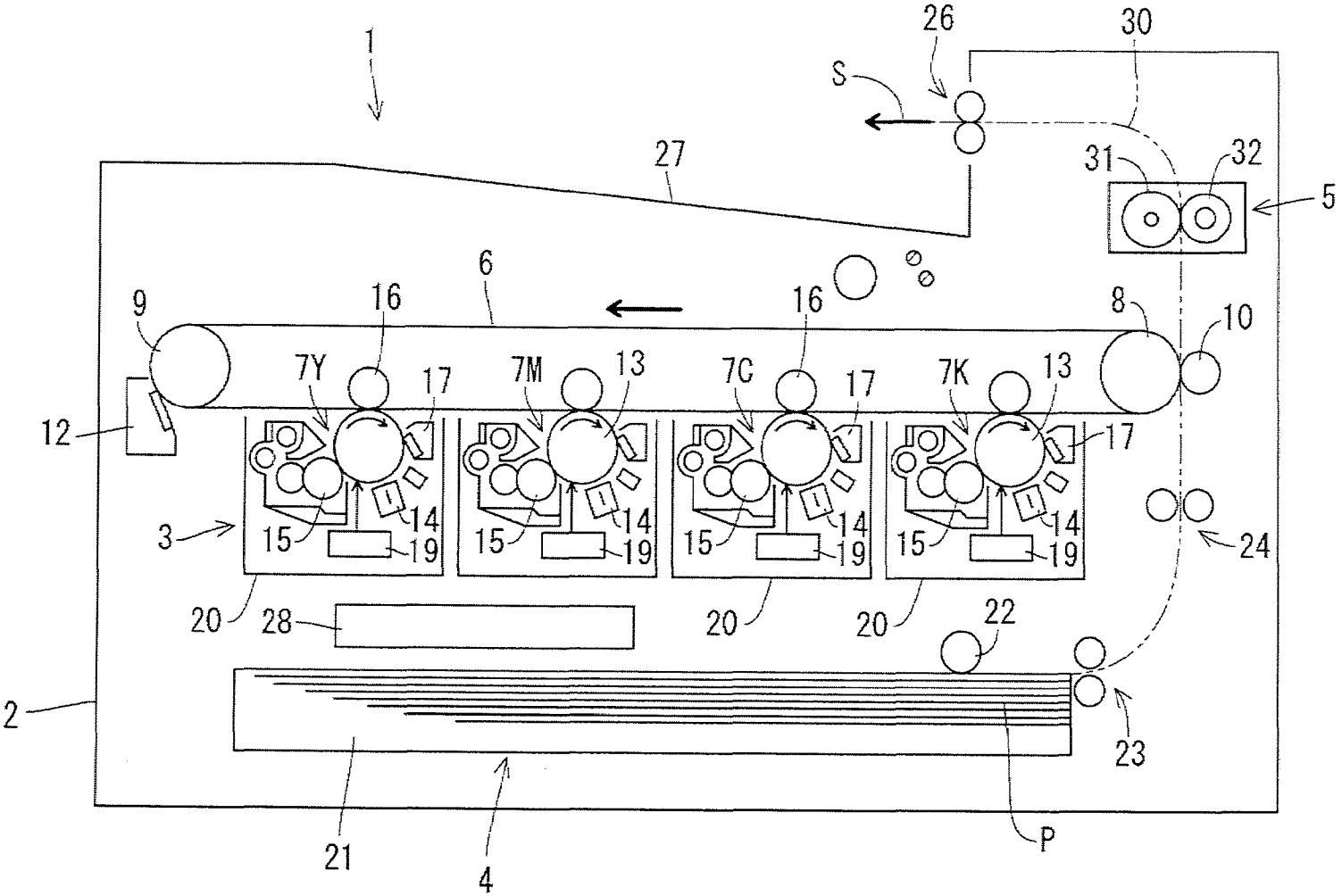
FIG. 1 is a schematic explanatory diagram illustrating a printer.

Hereinafter, embodiments of the present invention will be described below with reference to the drawings illustrating the application of a tandem color digital printer (hereinafter, referred to as a printer) as one example of an image forming apparatus. However, the scope of the invention is not limited to the illustrated examples. It is noted that, in the following description, terms each indicate a specific direction or position (e.g., "right and left" or "upper and lower"), and when the terms are used as necessary, the planar direction of the drawing of FIG. 1 is defined as the front view, as a reference. The terms are used for convenience of description, and are not intended to limit the technical scope of the present invention.

(1) Summary of Printer

First, a summary of the printer 1 will be described with reference to FIG. 1. As illustrated in FIG. 1, the printer 1 includes a casing 2, and further includes an image processor 3, a paper feeder 4, a fuser 5, and the like in the casing 2. Although detailed illustration is not made in FIG. 1, the printer 1 is connected to a network such as a LAN to perform printing based on a print command from an external terminal (illustration is omitted) upon receiving the command.

A paper feeder 4 positioned at the lower part in the casing 2 includes a paper feed cassette 21, a pickup roller 22, a pair of separation rollers 23, and a pair of timing rollers 24, and the like. The paper feed cassette 21 houses a recording material P. The pickup roller 22 feeds the recording material P on the uppermost layer in the paper feed cassette 21. The pair of separation rollers 23 separates the fed recording materials P one by one. The pair of timing rollers 24 conveys the separated one recording material P to the image processor 3 with predetermined timing. The recording material P on the uppermost layer in the paper feed cassette 21 is fed out one by one to a conveying path 30 by the rotation of the pickup roller 22 and the separation rollers 23. The conveying path 30 extends from the paper feed cassette 21 of the paper feeder 4 to an exit roller pair 26 at an upper part of the casing 2, through a nip between the timing roller 24 pair, a secondary transfer nip of the image processor 3, and a fusing nip 33 of the fuser 5.

The recording materials P in the paper feed cassette 21 are set relative to the center for conveyance to the conveying path 30 in a direction indicated by an arrow S, based on the center of a sheet passage width (a width dimension perpendicular to the direction indicated by the arrow S). Although illustration is omitted, the paper feed cassette 21 internally includes a pair of side regulation plates configured to align the width of the recording materials P before feeding, relative to the center. The pair of side regulation plates are moved in association with each other to access and separate from each other in a direction of the sheet passage width. The recording materials P in the paper feed cassette 21 are held by the pair of side regulation plates from both sides in the direction of the sheet passage width, and the recording materials P in the paper feed cassette 21 are set relative to the center regardless of their specification. Accordingly, transfer processing at the image processor 3 or fusing processing at the fuser 5 is also performed relative to the center.

The image processor 3 positioned above the paper feeder 4 transfers a toner image formed on a photoreceptor drum 13 as one example of an image carrier, to the recording material P. The image processor 3 includes an intermediate transfer belt. 6 as an intermediate transfer body, four imaging units 7 corresponding to colors of yellow (Y), magenta (M), cyan (C), and black (K), and the like.

The intermediate transfer belt 6 includes an electrically conductive material, has an endless form, and is also one example of the image carrier. In the casing 2, the intermediate transfer belt 6 is wound around a driving roller 8 positioned on the right side of the center, and a driven roller 9 positioned on the left side of the center. A secondary transfer roller 10 is disposed on the outside of a portion of the intermediate transfer belt 6 wound on the driving roller 8. Power of a main motor (illustration is omitted) is transmitted to rotate the driving roller 8 counterclockwise according to FIG. 1, and the intermediate transfer belt 6 rotates counterclockwise according to FIG. 1.

On the outer peripheral side of the portion of the intermediate transfer belt 6 wound on the driving roller 8, the secondary transfer roller 10 is disposed. The secondary transfer roller 10 abuts on the intermediate transfer belt 6, and a portion (abutment portion) between the intermediate transfer belt 6 and the secondary transfer roller 10 is formed to be a secondary transfer nip as a secondary transfer region. The secondary transfer roller 10 is rotated clockwise according to FIG. 1, with the rotation of the intermediate transfer belt 6, or with the movement of the recording material P held and conveyed through the secondary transfer nip. On the outer peripheral side of a portion of the intermediate transfer belt 6 wound on the driven roller 9, a transfer belt cleaner 12 is disposed for removing untransferred toner on the intermediate transfer belt 6. The transfer belt cleaner 12 abuts on the intermediate transfer belt 6.

The four imaging units 7 are arranged under the intermediate transfer belt 6, in the order of yellow (Y), magenta (M), cyan (C), and black (K), from the left side according to FIG. 1, along the intermediate transfer belt 6. In FIG. 1, for convenience of description, the imaging units 7 are denoted by reference signs Y, M, C, and K, respectively, according to reproduced colors. Each of the imaging units 7 includes a photoreceptor drum 13, as one example of the image carrier, rotated clockwise according to FIG. 1. Around the photoreceptor drum 13, a charging device 14, an exposure device 19, a developing device 15, a primary transfer roller 16, and a photoreceptor cleaner 17 are sequentially disposed along a clockwise rotational direction according to FIG. 1.

The photoreceptor drum 13 has a negative chargeability, and is rotated clockwise according to FIG. 1, by the power transmitted from the main motor. The charging device 14 uniformly charges the surface of the photoreceptor drum. The developing device 15 uses toner having negative polarity to expose an electrostatic latent image formed on the photoreceptor drum 13 by reversal development.

The primary transfer roller 16 is positioned on the inner peripheral side of the intermediate transfer belt 6, and faces the photoreceptor drum 13 of the corresponding imaging unit 7 across the intermediate transfer belt 6. The primary transfer roller 16 is also rotated counterclockwise according to FIG. 1, with the rotation of the intermediate transfer belt 6. A portion between the intermediate transfer belt 6 and the primary transfer roller 16 (abutment portion) is formed to be a primary transfer nip as a primary transfer region. The photoreceptor cleaner 17 is used for removing the untransferred toner remaining on the photoreceptor drum 13, and abuts on the photoreceptor drum 13. Under each of the four imaging units 7, the exposure device 19 is disposed. The exposure device 19 forms an electrostatic latent image on each photoreceptor drum 13 using laser light based on image information from the external terminal or the like.

Each imaging unit 7 integrally houses the photoreceptor drum 13, the charging device 14, the exposure device 19, the developing device 15, and the photoreceptor cleaner 17 in a housing 20 to form a cartridge (integral structure), and the imaging unit 7 is mounted, as a so-called process cartridge, to the casing 2 replaceably (detachably). It is noted that, above the intermediate transfer belt 6, a hopper (illustration is omitted) is disposed which houses toner to be fed to each developing device 15.

In each imaging unit 7, when laser light corresponding to an image signal is projected to the photoreceptor drum 13 charged by the charging device 14 from the exposure device 19, the electrostatic latent image is formed. The electrostatic latent image is reversely developed with toner fed from the developing device 15 into the toner image of each color. The toner image on each photoreceptor drum 13 is superposedly transferred primarily from the photoreceptor drum 13 to the outer peripheral surface of the intermediate transfer belt 6, in the order of yellow, magenta, cyan, and black, in each corresponding primary transfer nip. The untransferred toner remaining on the photoreceptor drum 13 is scraped by the photoreceptor cleaner 17, and removed from the photoreceptor drum 13. When the recording material P passes through the secondary transfer nip, the superposed toner images of four colors are secondarily transferred collectively onto the recording material P. The untransferred toner remaining on the intermediate transfer belt 6 is scraped by the transfer belt cleaner 12, and is removed from the intermediate transfer belt 6.

The fuser 5 is positioned above the secondary transfer roller 10, and includes a fusing roller member 31, and a pressure roller member 32 making pressure-contact with the fusing roller member 31. An abutment portion between the fusing roller member 31 and the pressure roller member 32 is formed to be the fusing nip 33 as a fusing region. The recording material P having an unfixed toner image thereon, passes through the secondary transfer nip, and is heated and pressed upon passage through the fusing nip 33 between the fusing roller member 31 and the pressure roller member 32, and thereby the toner image is fixed on the recording material P. Thereafter, the recording material P is separated from the fusing roller member 31 by a separating member 34 provided downstream of the fusing nip 33, conveyed on the conveying path 30, and output to a paper output tray 27 by the rotation of the exit roller pair 26.

In the casing 2, a control unit 28 is disposed between the image processor 3 and the paper feeder 4. The control unit 28 generally controls the printer 1. The control unit 28 includes a controller (illustration is omitted) configured to perform various arithmetic processing, storage, and control.

(2) Fuser According to First Embodiment and Detailed Peripheral Configuration Thereof Next, the fuser 5 according to a first embodiment and a detailed peripheral configuration thereof will be described with reference to FIGS. 2 and 3. As described above, the fuser 5 includes the fusing roller member 31, the pressure roller member 32, the separating member 34, and a heating unit 35. The fusing roller member 31, the pressure roller member 32, the separating member 34, and the heating unit 35 extend in a direction of sheet passage width, and are rotated in pressure-contact with each other.

The fusing roller member 31 includes a pressing member 41, a fusing belt 42, a tension member 43, and a restriction flange 44. The pressing member 41 is rotatably provided. The fusing belt 42 is defined as a belt body wound around the pressing member 41. The tension member 43 abuts on the inside of the fusing belt 42, and applies tension to the fusing belt 42. The restriction flange 44 is disposed along each longitudinal end surface of the fusing belt 42. In the present embodiment, The pressing member 41 is a roller having a substantially circular cross-sectional shape and fixed on a rod-shaped mandrel, and presses the fusing nip 33 from the inside of the fusing belt 42. The pressing member 41 includes for example silicone sponge, and is thermally expanded. The pressing member 41 is rotatably journaled in the casing 2 of the printer 1 through the mandrel including a non-magnetic material. According to the first embodiment, the fusing belt 42 has an endless form and constituting the outer peripheral portion of the fusing roller member 31. The fusing belt 42 has a cylindrical shape elongated in the direction of sheet passage width. The fusing belt 42 holds the cylindrical shape by the tension of the pressing member 41, the tension member 43, and the fusing belt itself, and the fusing belt 42 rotates along the cylindrical shape. Further, the pressing member 41 has an external shape smaller than the inner diameter of the fusing belt 42. As one example, the external shape of the pressing member 41 is reduced by approximately several millimeters at room temperature relative to the inner diameter of the fusing belt 42.

The pressing member 41 is usually urged by an urging member (illustration is omitted) such as a compression spring, toward the conveying path 30. Therefore, the pressing member 41 presses the fusing belt 42 in a direction perpendicular to the conveying path 30. As illustrated in FIG. 3, the external shape of the pressing member 41 is smaller than the inner diameter of the fusing belt 42 by several millimeters, so that a gap is formed between the fusing belt 42 and the pressing member 41, excluding the fusing nip 33 and a vicinity of the fusing nip 33.

In the present embodiment, the fusing belt 42 includes a release layer, an elastic layer having elasticity, and a heating layer, sequentially from the outside. As one example of configurations of the layers, the release layer includes a fluororesin layer or the like, and the elastic layer includes silicone rubber or the like. The heating layer includes a conductive material such as Ni, SUS, Fe or the like.

A pressure roller 46, as the pressure roller member 32, is disposed on the outer peripheral side of a portion of the fusing belt 42 wound on the pressing member 41, specifically, in a direction toward the conveying path 30. The pressure roller 46 makes pressure-contact with the pressing member 41 through the fusing belt 42, and a portion (abutment portion) between the fusing belt 42 and the pressure roller 46 is formed to be the fusing nip 33 as a fusing region. Power is transmitted to the pressure roller 46 from a fusing motor (illustration is omitted) as a driving source through a power transmission system, such as a gear wheel or a belt, and the pressure roller 46 is rotationally driven clockwise in FIGS. 1 and 3. With rotation of the pressure roller 46, or passage of a recording material P through the fusing nip 33, the fusing belt 42 is rotated in a direction opposite to that of the pressure roller 46 (counter-clockwise according to FIG. 1).

The tension member 43 applies tension to the fusing belt 42 to maintain a circumferential path of the fusing belt 42. The tension member 43 is configured to apply tension to the fusing belt 42 outwardly from the center. Specifically, tension of less than 1N, for example approximately 0.3N, is applied to the fusing belt 42 from the inside. Therefore, the tension member 43 has an external shape slightly larger than the inner diameter of the fusing belt 42. For example, the external shape of the tension member 43 is increased by approximately several ten micrometers to several hundred micrometers at room temperature, relative to the inner diameter of the fusing belt 42. Further, the tension member 43 applies tension to the fusing belt 42, regardless of whether the pressing member 41 is thermally expanded, and maintains the circumferential path of the fusing belt 42.

A material of the tension member 43 is not particularly limited, and is preferably selected from metals, heat-resistant resins, and the like appropriately. As one example of the material of the tension member 43, a PAI (polyamide imide) is employed from a viewpoint of reduction in abrasion of the fusing belt 42 and the tension member 43 which are caused by frictional sliding with the fusing belt 42, fluorine is coated on the inside of the fusing belt 42, and fluorine-based grease is coated on an inside of the fusing belt 42 or an outside of the tension member 43 (portion facing the inside of the fusing belt 42).

Figure 4:
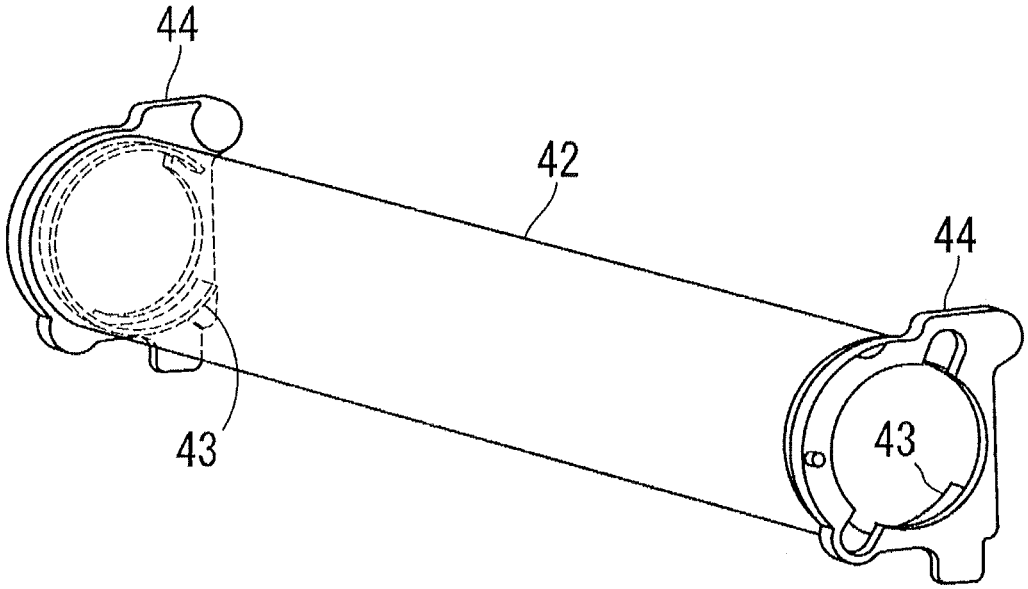
FIG. 4 is a schematic perspective view of the fuser.
Figure 5A:
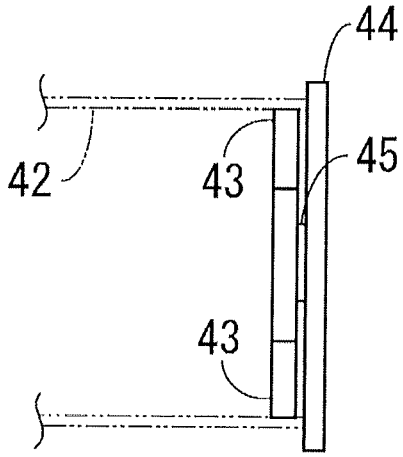
FIG. 5A is a schematic axial cross-sectional view of the fuser.
Figure 5B:
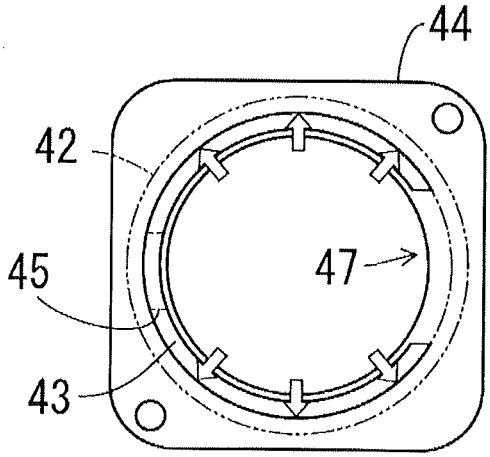
FIG. 5B is a schematic side cross-sectional view of the fuser.

As illustrated in FIGS. 4, 5A, and 5B, the tension members 43 according to the present embodiment are partially connected to the restriction flanges 44 by connectors 45 each provided at a position opposite to the fusing nip 33 relative to the mandrel of the pressing member 41, and abut on both longitudinal ends of the fusing belt 42. In the present embodiment, a slit (gap) is formed in a portion other than the connector 45 between the tension member 43 and the restriction flange 44. In this configuration, the tension member 43 and the restriction flange 44 may include the same or different materials. Further, the tension member 43 and the restriction flange 44 may be integrated with each other, or may be fixed to each other through another connection member.

Additionally, as illustrated in FIGS. 5A and 5B, the tension member 43 has a C-shaped cross-section in front view to have an opening region 47 not making contact with the fusing belt 42. In this configuration, the opening region 47 of the tension member 43 is fitted to the fusing nip 33 (toward conveying path 30), thereby the fusing belt 42 has a uniform recessed cross-sectional shape even at a position at which the tension member 43 is disposed, in the opening region 47 of the tension member 43, regardless of the inside or outside a region of the fusing nip 33. Owing to this configuration, deformation stress is maintained, and durability of the fusing belt 42 is increased.

Additionally, the tension member 43 is formed with the slit in the portion other than the connector to the restriction flange 44, has the C-shaped cross-section, and has the opening region 47 making no contact with the fusing belt 42. Therefore, the tension member 43 is resiliently deformed radially (radial direction of fusing belt 42). Therefore, the fusing belt 42 is readily fit to the tension member 43 to facilitate assembling work.

It is noted that a range of the connector between the tension member 43 and the restriction flange 44, the cross-sectional shape of the tension member 43 in front view, and the opening region 47 of the tension member 43 are not limited to the configuration having been described above, but it is preferable that the tension members 43 are configured to be resiliently deformed radially, from the viewpoint of securing assembling workability.

Figure 2:
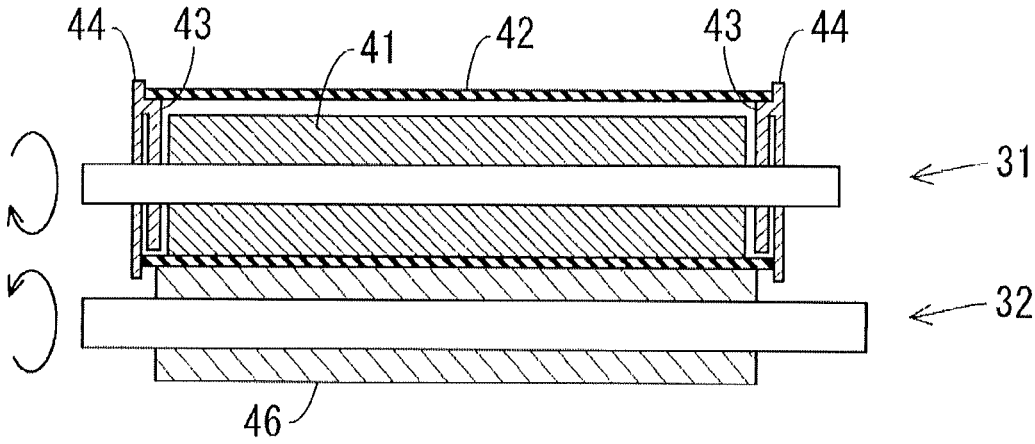
FIG. 2 is a schematic axial cross-sectional view illustrating a fuser according to a first embodiment.

As illustrated in FIG. 2, the restriction flanges 44 restrict a longitudinal position of the fusing belt 42, and either one of the longitudinal both ends of the fusing belt 42 is configured to abut on either one of the restriction flanges 44. Further, a material of the restriction flange 44 is not particularly limited, and may be selected from metals, heat-resistant resins, and the like appropriately.

Figure 3:
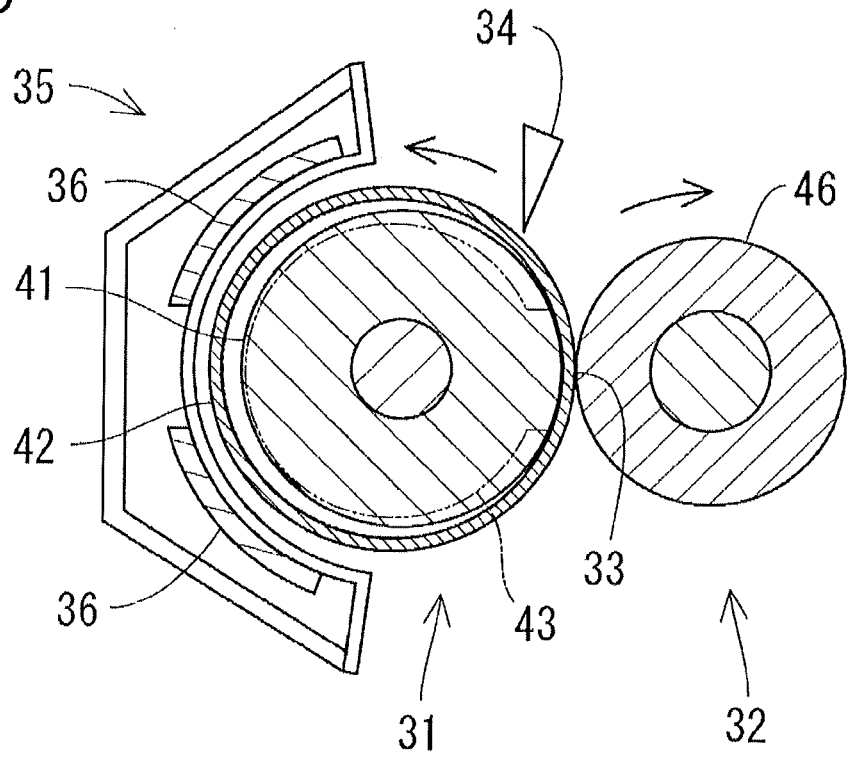
FIG. 3 is a schematic side cross-sectional view of the fuser.

As illustrated in FIG. 3, in the fuser 5, the separating member 34 configured to separate the recording material P from the fusing belt 42 is disposed downstream of the fusing nip 33, closely to the fusing belt 42. A gap between the fusing belt 42 and the separating member 34 is appropriately set according to a maximum sheet passage area (maximum sheet passage size) of the recording material P or a peripheral component structure, but, as one example, the gap can be set to approximately 0.2 mm to 0.7 mm. Here, the separating member 34 may extend over substantially the maximum sheet passage area of the recording material P along the longitudinal direction of the fusing belt 42, or the separating member 34 may be divided into a plurality of portions to be disposed along the longitudinal direction of the fusing belt 42 side by side.

In the present embodiment, the heating unit 35 is a magnetic flux generator, and inductively heats the heating layer formed in the fusing belt 42. Specifically, the heating unit 35 has an exciting coil 36 configured by winding a conductive wire along the longitudinal direction of the fusing belt 42 on the opposite side (upper side in FIGS. 2 and 3) of the fusing roller member 31 to the conveying path 30. The exciting coil 36 is connected to a high frequency power source (illustration is omitted), and is supplied with a high-frequency current of 20 kHz to 90 kHz, 100 W to 1500 W. Therefore, as one example, a litz wire obtained by braiding several ten to several hundred thin wires coated with a heat resistant resin can be employed. A magnetic flux induced by the exciting coil 36 induces an eddy current in the heating layer formed in the fusing belt 42, Joule heat is generated in the heating layer, and the fusing belt 42 is heated.

It is noted that the fusing belt 42 is brought into contact with or closely disposed with a temperature sensor (illustration is omitted). According to a result of detection by the temperature sensor, the heating unit 35 is controlled, and the fusing belt 42 is maintained at a predetermined fusing temperature.

According to the configuration of the first embodiment, in order to maintain the circumferential path of the fusing belt 42, the tension member 43 applies tension to the fusing belt 42 outwardly from the center, and thus, a circumferential position of the fusing belt 42 is stabilized, and contact between the fusing belt 42 and the separating member 34 is prevented. Therefore, a contact trace is prevented from remaining on the fusing belt 42, and quality of fusing is surely secured without generation of uneven gloss in image fixation which is caused by the contact trace.

Further, the circumferential position of the fusing belt 42 can be stabilized, and a relative position between the fusing belt 42 and the separating member 34 is adjusted easily. The gap does not need to be increased to prevent the contact between the fusing belt 42 and the separating member 34, and the gap between them can be set to be suitable for separation of the recording material P. Therefore, shortcomings, such as winding of the recording material P around the fusing belt 42, are overcome, and reliability of the fuser 5 can be increased.

Further, the fusing belt 42 has the heating layer including a conductive metal, the heating layer is inductively heated by the heating unit 35 as the magnetic flux generator, the fusing belt 42 itself is heated, and the heating layer having a low heat capacity is defined as a heating body. Accordingly, the fusing belt 42 is heated to a predetermined fusing temperature quickly and with reduced energy, and the predetermined fusing temperature can be maintained with reduced energy.

In addition, the gap is formed between the fusing belt 42 and the pressing member 41, excluding the fusing nip 33 and the vicinity of the fusing nip 33, and the gap is maintained by the tension member 43 to inhibit the heat loss of the heated fusing belt 42 to the pressing member 41. Accordingly, the fusing belt 42 is heated to a predetermined fusing temperature quickly and with reduced energy, and the predetermined fusing temperature can be maintained with reduced energy.

Figure 6:
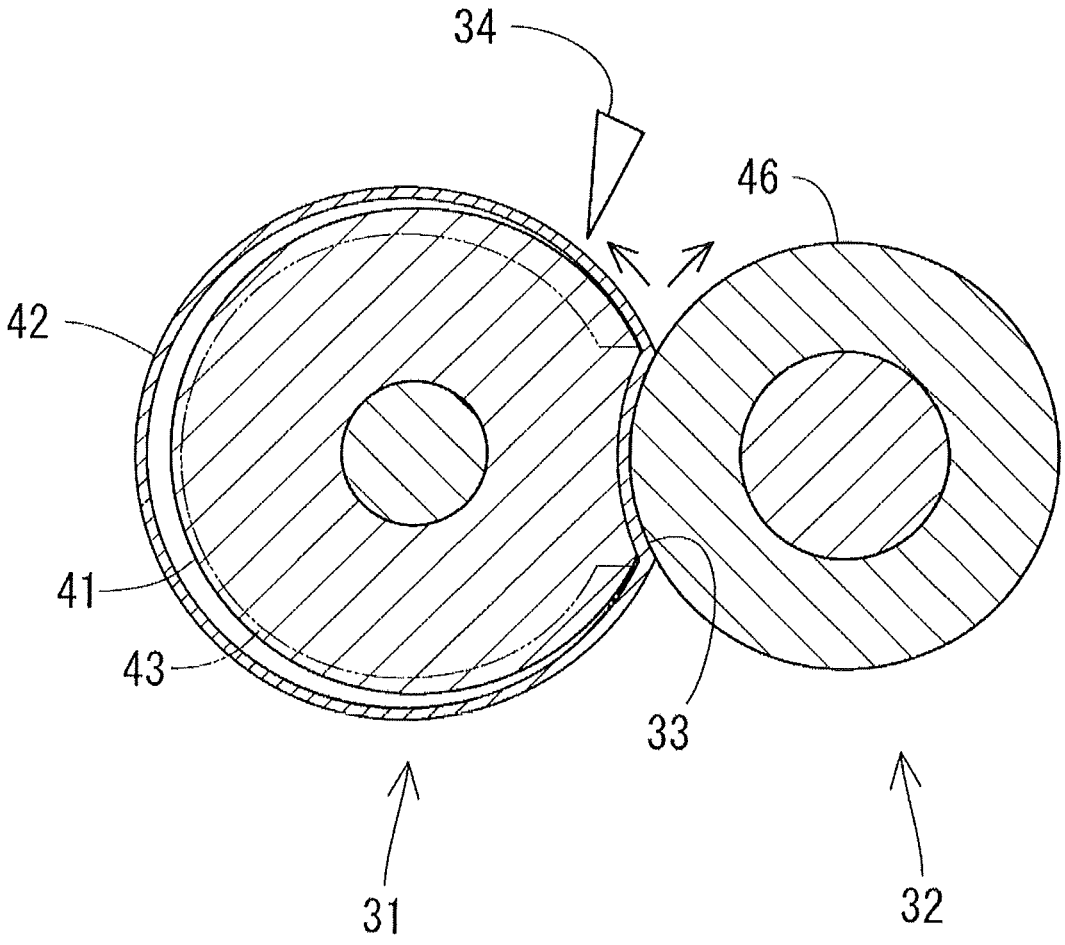
FIG. 6 is a schematic side cross-sectional view of the fuser at room temperature.
Figure 7:
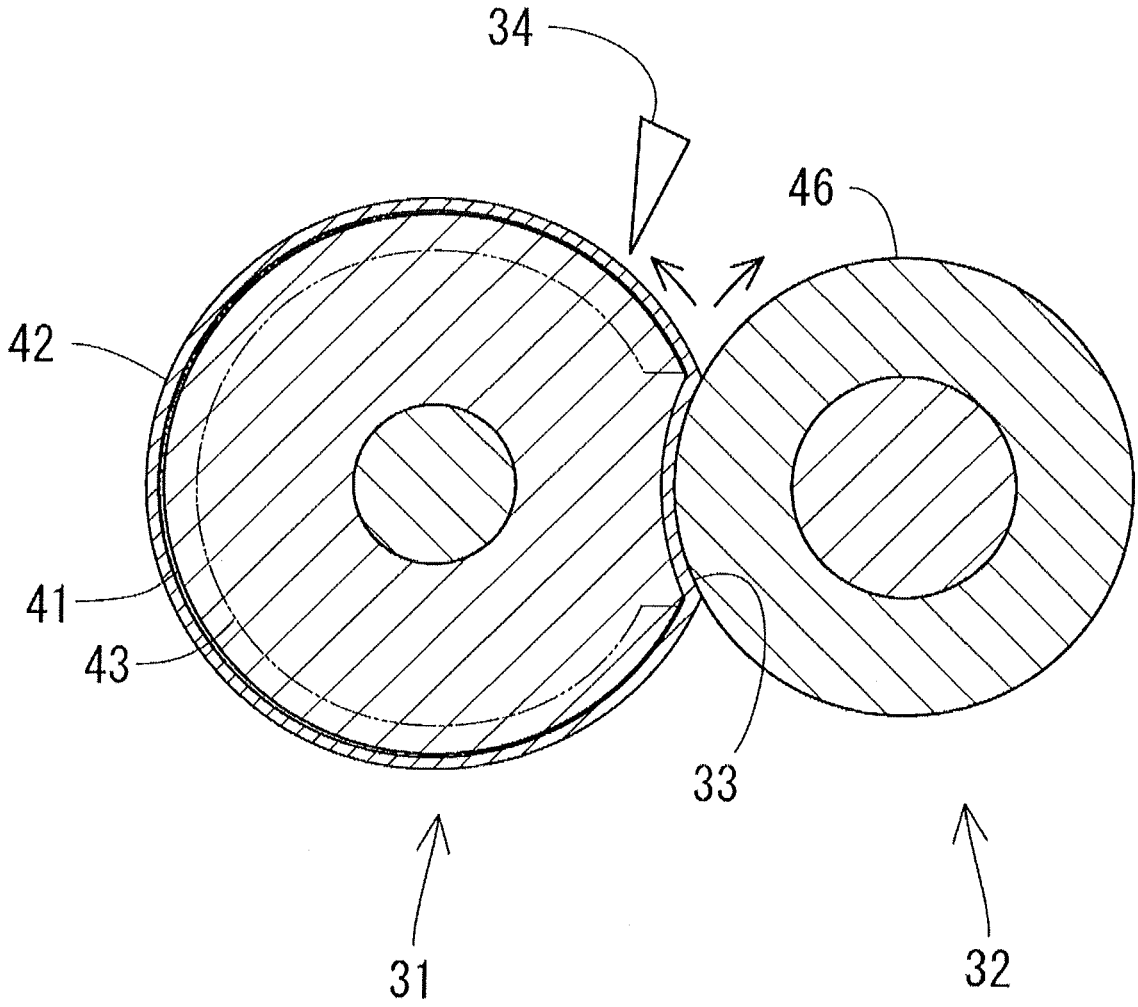
FIG. 7 is a schematic side cross-sectional view of the fuser at a fusing temperature.

Here, as described above, the pressing member 41 includes a thermal expansion material, and, as illustrated in FIGS. 6 and 7, when the pressing member 41 is thermally expanded, contact pressure between the tension member 43 and the fusing belt 42 is reduced. FIG. 6 illustrates the pressing member 41 at room temperature, or before thermal expansion. The gap between the fusing belt 42 and the pressing member 41 is large, and the circumferential path of the fusing belt 42 is maintained by the tension member 43 in a direction other than a pressing direction of the pressing member 41. FIG. 7 illustrates the pressing member 41 at a predetermined fusing temperature, or in thermal expansion. The gap between the fusing belt 42 and the pressing member 41 of a roller shape is reduced. Accordingly, a range of the circumferential path of the fusing belt 42, maintained by the pressing member 41, is increased, and the contact pressure between the tension member 43 and the fusing belt 42 is reduced. Therefore, during fusing operation, frictional resistance between the tension member 43 and the fusing belt 42 is reduced, and disadvantageous reduction of the life of the fusing belt 42 is inhibited.

(3) Fusers according to Second, Third, and Fourth Embodiments and Detailed Peripheral Configurations Thereof Next, fusers 5 according to second, third, and fourth embodiments, and detailed peripheral configurations thereof will be described with reference to FIGS. 8, 9, 10A, and 10B. The fusers 5 according to the second, third, and fourth embodiments include fusing roller members 31 having configurations different from the fusing roller member according to the first embodiment.

Figure 8:
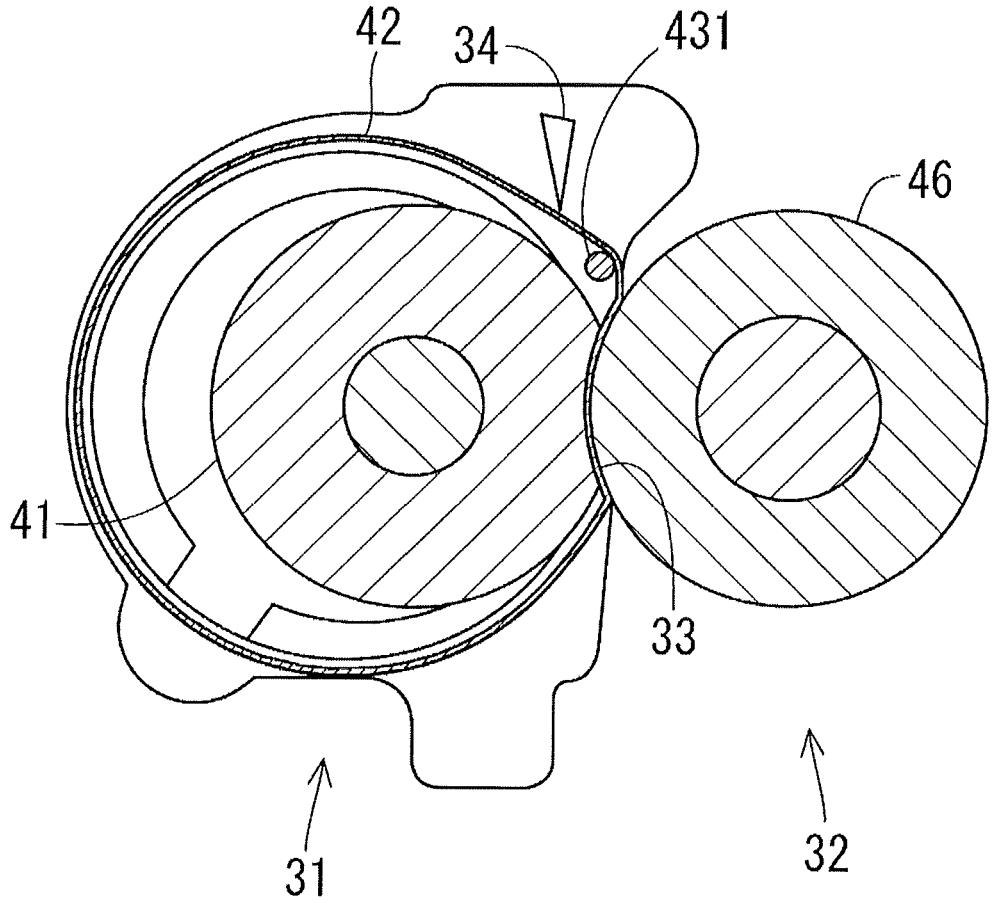
FIG. 8 is a schematic side cross-sectional view of a fuser according to a second embodiment.

That is, in the fusing roller member 31 according to the second embodiment of FIG. 8, a tension member 431 is configured as a protruding portion, on the downstream side from a fusing nip 33 in a circumferential path of a fusing belt 42. The protruding portion outwardly protrudes the circumferential path of the fusing belt 42 to partially increase a curvature of the circumferential path. The other configurations are substantially the same as those of the first embodiment. Even with the configuration having been described above, an effect similar to the first embodiment can be obtained. In addition, according to the configuration of the second embodiment, even if a recording material P has difficulty in separation, for example, the recording material is a thin paper sheet or a breakable coated paper sheet, a portion having a large curvature facilitates separation of the recording material P, and separability thereof is increased. Further, even if a gap between the fusing belt 42 and a separating member 34 is increased relative to a conventional setting, the separability of the recording material P can be secured. Therefore, the gap between the fusing belt 42 and the separating member 34 can be set large to simplify adjustment.

Figure 9:
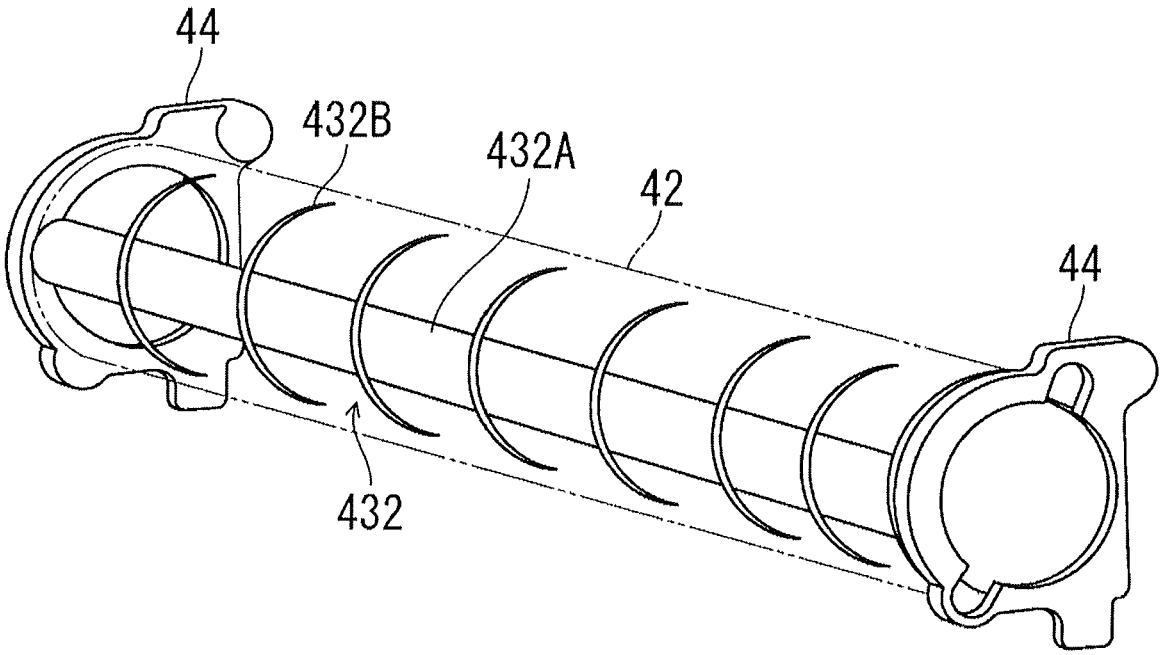
FIG. 9 is a schematic perspective view of a fuser according to a third embodiment.

In the fusing roller member 31 according to the third embodiment of FIG. 9, a tension member 432 abuts on the inside of a fusing belt 42 at least in a range corresponding to a separating member 34 in a longitudinal direction of the fusing belt 42. Specifically, the tension member 432 includes a substrate 432A and a plurality of guide pieces 432B. The substrate 432A has a long plate shape, and provided in a gap between the fusing belt 42 and a pressing member 41 formed on the opposite side of a fusing nip 33, over the longitudinal direction of the fusing belt 42. The plurality of guide pieces 432B extends in a direction perpendicular to the substrate 432A, and is provided at substantially equal intervals on the substrate 432A. The substrate 432A is connected to flanges 44 provided at both ends of the fusing belt 42. In the present embodiment, the tension member 432 is configured to abut on a plurality of parts of the fusing belt 42 at equal intervals in the whole longitudinal direction of the fusing belt 42. The other configurations are substantially the same as those of the first embodiment. Even with the configuration having been described above, an effect similar to the first embodiment can be obtained. In addition, according to the configuration of the third embodiment, the tension member 432 abuts on at least a range corresponding to the separating member 34 in the longitudinal direction of the fusing belt 42, so that a circumferential path of the fusing belt 42 can be maintained in the range corresponding to the separating member 34. Further, concentration of stress on both longitudinal ends of the fusing belt 42 is avoided to increase durability of the fusing belt 42.

Figure 10A:
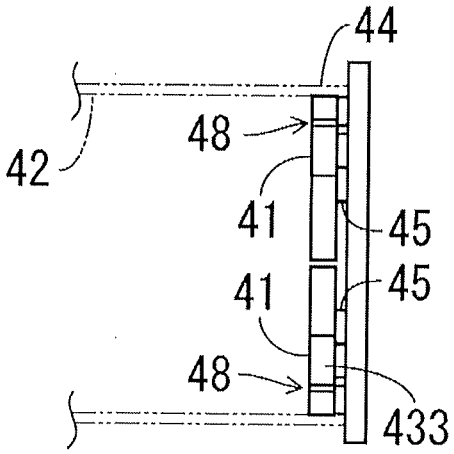
FIG. 10A is a schematic axial cross-sectional view of a fuser according to a fourth embodiment.
Figure 10B:
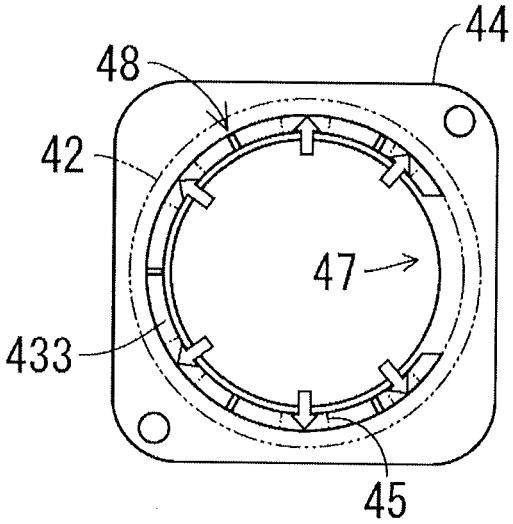
FIG. 10B is a schematic side cross-sectional view of the fuser according to the fourth embodiment.
Figure 11:
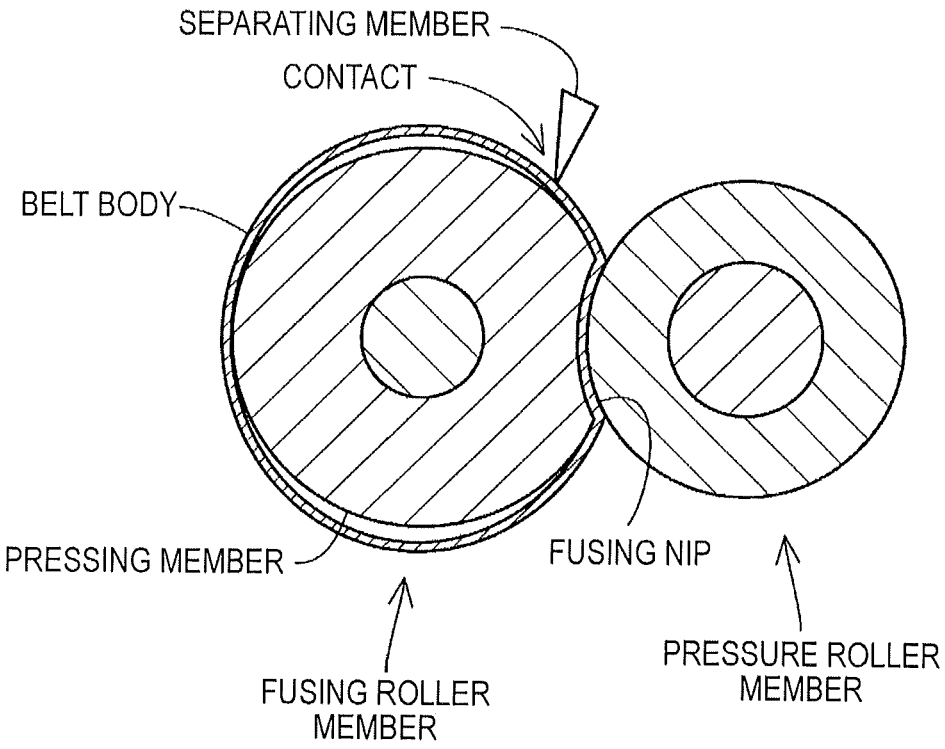
FIG. 11 is a schematic side cross-sectional view of a conventional fuser.

In the fusing roller member 31 according to the fourth embodiment of FIGS. 10A and 10B, a tension member 433 is divided into a plurality of portions to be disposed along a circumferential path of a fusing belt 42. Tension of the divided tension members 433 is preferably adjusted individually. Specifically, the plurality of divided tension members 433 are partially connected to a restriction flange 44 by connectors 45. The other configurations are substantially the same as those of the first embodiment. Even with the configuration having been described above, an effect similar to the first embodiment can be obtained. In addition, according to the configuration of the fourth embodiment, tension of the plurality of divided tension members 433 along the circumferential path of the fusing belt 42 can be adjusted individually, so that a load distribution on the fusing belt 42 is uniformed, and durability of the fusing belt 42 is increased.

(4) Others

The present invention is not limited to the embodiments having been described above, but can be embodied in various modes. For example, the printer has been described as the image forming apparatus, but the invention is not limited to the printer, and a copying machine, a facsimile machine, a multifunction printer including the functions of copying and facsimile machines, or the like may be employed. As another mode of the heating unit 35, the heating unit may employ a fusing roller member 31 internally including a resistance heating element such as a heater lamp for heating, or the heating unit may employ a fusing belt 42 having an inner surface painted black, a fusing belt 42 having an inner surface including a halogen heater, and a fixing member including a halogen light reflection member. Rotation power may be transmitted to the fusing roller member 31 or a pressure roller member 32, but the rotation power is preferably transmitted to the pressure roller member 32 to drive the fusing roller member 31 for rotation. Both of the roller members 31 and 32 can be configured to receive the transmission of the rotation power, respectively. Configurations of component units are not limited to the embodiments having been illustrated, and various modifications can be made without departing from the scope of the present invention.

Further, when the pressure roller member 32 has a belt configuration having the pressing member 41 and the fusing belt 42 of the fusing roller member 31 according to the embodiments having been described above, either one of the tension members 43, 431, 432, and 433 of the embodiments may be applied to the pressure roller member 32. When both of the fusing roller member 31 and the pressure roller member 32 have the belt configuration, either one of the tension members 43, 431, 432, and 433 may be applied to both of the fusing roller member 31 and the pressure roller member 32.

In addition, the present invention may further include a connection-disconnection mechanism configured to switch the fusing roller member 31 and the pressure roller member 32 between a pressing state in which the fusing roller member 31 and the pressure roller member 32 are brought into pressure-contact with each other, and a separation state in which the fusing roller member 31 and the pressure roller member 32 are separated from each other. In this configuration, the tension members 43, 431, 432, and 433 are preferably configured to apply tension to the fusing belt 42 in either of the pressing state and the separation state.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fuser including a fusing roller member configured to heat an unfixed toner image on a recording material, and a pressure roller member making pressure-contact with the fusing roller member, the fuser configured to fix the toner image by passing the recording material through a fusing nip between the fusing roller member and the pressure roller member, the fuser comprising:

an endless belt body constituting an outer peripheral portion of the fusing roller member or the pressure roller member, the endless belt body rotating in a predetermined circumferential path;

a pressing member configured to press the fusing nip from the inside of the belt body;

a separating member configured to separate the recording material from the belt body; and a tension member abutting on an inside of the belt body for tension, the tension member configured to maintain a gap between the belt body and the separating member;

wherein the pressing member has a roller shape, includes a material expanded upon heating, and when the pressing member is thermally expanded, pressure-contact between the tension member and the belt body is reduced.

2. The fuser according to claim 1, wherein a gap is formed between the belt body and the pressing member, excluding the fusing nip and a vicinity of the fusing nip.

3. The fuser according to claim 1, further comprising a restriction flange disposed along each longitudinal end surface of the belt body, the restriction flange configured to restrict a longitudinal position of the belt body, wherein the tension member is fixed to the restriction flange, and abuts on each longitudinal end of the belt body.

4. The fuser according to claim 1, wherein the tension member includes a protruding portion configured to make contact with an inner surface of the belt body on downstream side from the fusing nip in the circumferential path of the belt body, outwardly protrude the circumferential path of the belt body, and increase a curvature of the circumferential path.

5. The fuser according to claim 1, wherein the tension member is extended over substantially the longitudinal direction of the belt body, and abuts on an inside of the belt body.

6. The fuser according to claim 1, wherein the belt body is longer than the fusing nip in the longitudinal direction, and the tension member is disposed outside an area of the fusing nip.

7. The fuser according to claim 1, comprising a heating unit disposed to face the circumferential surface of the belt body and configured to inductively heat a metal material, wherein the belt body includes a heating layer including a metal material.

8. An image forming apparatus comprising the fuser according to claim 1.

* * * * *